United States Patent [19]

Schoff

[11] 4,101,190

[45] Jul. 18, 1978

[54] INDICATOR DEVICE FOR MODULAR HEATING CABLE

[75] Inventor: Dale H. Schoff, New Carlisle, Ind.

[73] Assignee: Bristol Products, Inc., Bristol, Ind.

[21] Appl. No.: 772,731

[22] Filed: Feb. 28, 1977

[51] Int. Cl.[2] ..... H01R 3/00

[52] U.S. Cl. ..... 339/113 L; 219/528; 339/153

[58] Field of Search ..... 339/113 L, 113 R, 153, 339/154 A, 154 R; 219/528, 506

[56] References Cited

U.S. PATENT DOCUMENTS

| | | | |
|---|---|---|---|
| 3,341,690 | 9/1967 | Commins | 219/528 |
| 3,924,914 | 12/1975 | Banner | 339/113 L X |

*Primary Examiner*—Roy Lake

*Assistant Examiner*—DeWalden W. Jones

*Attorney, Agent, or Firm*—Marmaduke A. Hobbs

[57] ABSTRACT

An indicator device for modular heating cables having male and female connectors for coupling the modules together, a plug with two terminals for connection with a female connector and a socket with two terminals for connection with the male connector, and a pair of electrical conducting elements connecting the terminals of the plug with the terminals of the socket. An indicator light is attached to the body and has leads connecting the light with the electrical conducting elements interconnecting the terminals of the plug and socket. The indicator light may be enclosed in an envelope and may be firmly attached to the body or on a flexible lead spaced therefrom.

12 Claims, 4 Drawing Figures

INDICATOR DEVICE FOR MODULAR HEATING CABLE

Flexible heating cables, tapes and bands are used extensively to protect water pipes from freezing in such applications as the main water pipe to mobile homes and trailers, particularly where the pipe is exposed between the ground and the bottom of the mobile home or trailer. There are also many other similar antifreeze applications where a water pipe is likely to be subjected to freezing temperatures in the structure or in crawl spaces beneath the floor. Various applications require different lengths of heating units, and some manufacturers supply an assortment of heating unit lengths to satisfy requirements for such various installations. This practice requires stocking of a large inventory of different lengths, some of which have only limited application, and hence limited sales. In order to overcome this stocking and inventory problem, a modular heating cable assembly has been devised, which permits the use in an installation of a number of standard length modules to obtain the required length, and those standard modules may be used to form various lengths and types of heating cable installations. The modular type heating cable assemblies, such as the type disclosed in U.S. Pat. No. 3,341,690, permits installations to be readily made from standard stock and to be changed from time to time to adapt the assembly to varying conditions and requirements without installing a complete new unit. The modular heating cable installations are sometimes relatively long, involving the coupling of a number of modules to a single outlet or source of electric power, and the integrity of each module is sometimes difficult to determine, in that the installation may be in a place difficult to reach and to feel the various modules. Consequently, the entire installation, or one or more modules may be inoperable for extended periods of time without this condition being known, thus possibly resulting in serious damage to the water pipes or system of the installation. Visual indicators have been used for single unit type heating cables, such as those disclosed in U.S. Pat. Nos. 3,305,668 and 3,851,149, but the indicating systems of those patents indicate only the integrity of the single unit connected to the source of electrical power and are only of limited value in a modular type of installation. It is therefore one of the principal objects of the present invention to provide a visual indicator device for determining the integrity of modular heating cables, which can be installed at the end of the assembly opposite the source of power, and/or between one or more modules, and which can be inserted in and removed from the assembly at any time after the installation has been made.

Another object of the invention is to provide an indicator device for modular heating assemblies, which is so constructed and designed that additional modules can be used to extend the cable assembly without removing any of the modules or indicator device, and which can also function as the final waterproof element of the modular assembly.

Another object of the invention is to provide an indicator device for a modular heating cable assembly of the aforesaid type, which is simple in construction and operation and easy to install in and remove from the assembly, and which is usable in a variety of different types of modular assembly installations.

Further objects and advantages of the present invention will become apparent from the following description and accompanying drawings, wherein.

Figure 1:
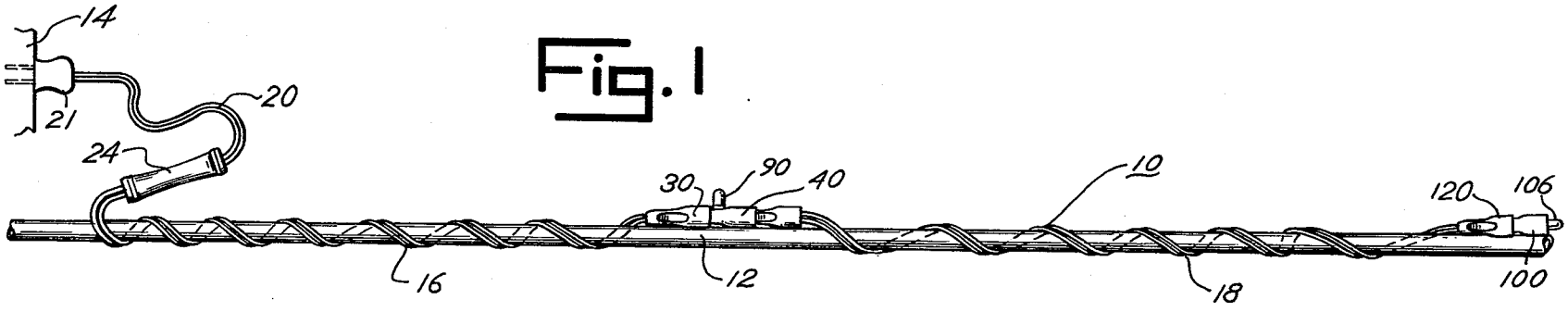
FIG. 1 is an elevational view of a modular heating cable installation illustrating the manner in which the indicator device of the present invention is incorporated therein.

Referring more specifically to the drawings, and to FIG. 1 in particular, numeral 10 indicates a modular heating cable assembly installed on a water pipe 12 and connected to an electrical outlet 14. While the modular heating assembly is shown spirally wound around the water pipe, various other configurations may be used to obtain the desired distribution of heat in the installation, and, while only two modules 16 and 18 are shown in FIG. 1, additional modules of the type indicated by numeral 18 may be employed to extend the length of the heating cable assembly to satisfy requirements.

In the embodiment of the invention illustrated in FIG. 1, the first module 16 consists of a cold lead 20 having a plug 21 for inserting in a conventional outlet socket 14 in which the source of electrical power is obtained for operating the heating cable assembly. This module includes a heating section 22 connected to the cold lead through a thermostat and leads associated therewith enclosed in plastic envelope 24. The details of the thermostat, which may include a by-pass switch for the purpose of testing the unit, are not considered a part of the invention and hence will not be disclosed in detail herein; however, several well known types are suitable for use in the present cable, such as the one disclosed in co-pending application Ser. No. 747,815 filed Dec. 6, 1976 (common assignee). The prior application also illustrates the manner in which the resistance heating wires may be connected in both modules 16 and 18 and the manner in which the cold leads may be used for transmission of the electrical current from one module to another, regardless of whether the heating element of any particular module is operative. Hence, the disclosure concerning the details of the various modules of the prior application is incorporated herein by reference. Module 22 terminates in a male connector 30 having an electrical socket 32 and preferably a thumb and finger gripping area 34 on opposite sides of base 36 of the connector.

In the assembly illustrated in the drawings, a device 40 for indicating the operation of the modules consists of a body 42 with a plug 44 at one end and a socket 46 at the other end, the plug 44 being adapted to seat in socket 32 and the two male terminals 48 and 50 being adapted to seat in holes 52 and 54 and to make contact therein with terminals 56 and 58, respectively. The two male terminals 48 and 50 are connected in body 42 to female terminals 60 and 62 which are adapted to receive terminals 64 and 66, respectively, of connector 70, the latter connector being permanently secured to the heating section 72 of module 18, and the connector 70 having thumb and finger gripping areas on opposite sides indicated generally by numeral 74. Terminals 48 and 50 may be formed integrally with terminals 60 and 62, respectively, or the respective terminals may be connected by wires or soldered or brazed joints. Regardless of how they are connected, the two male terminals and the respective female terminals are considered separate elements connected by electrical conducting means and are so described in claims. The connectors 30 and 70 and indicator device 40 are constructed of flexible but firm plastic material, and plug 44 preferably contains two sealing rings 76 and 78 which engage the internal surface 80 of socket 32 and form a water-tight seal therewith. Likewise, connector 70 preferably contains two sealing rings 82 and 84 for contacting the internal surface 86 of socket 46 to form a water-tight seal between the connector and socket when the parts are assembled. The indicator device contains a visual indicating means 90 having a light 92 disposed in a translucent envelope or capsule 94. The indicator light, preferably consisting of a high resistance neon light, is connected to terminals 60 and 62 by leads 95 and 96, and hence when the indicator device is assembled in the manner illustrated in FIGS. 1 and 2, the indicator light glows whenever the current is flowing between modules 16 and 18.

Figure 2:
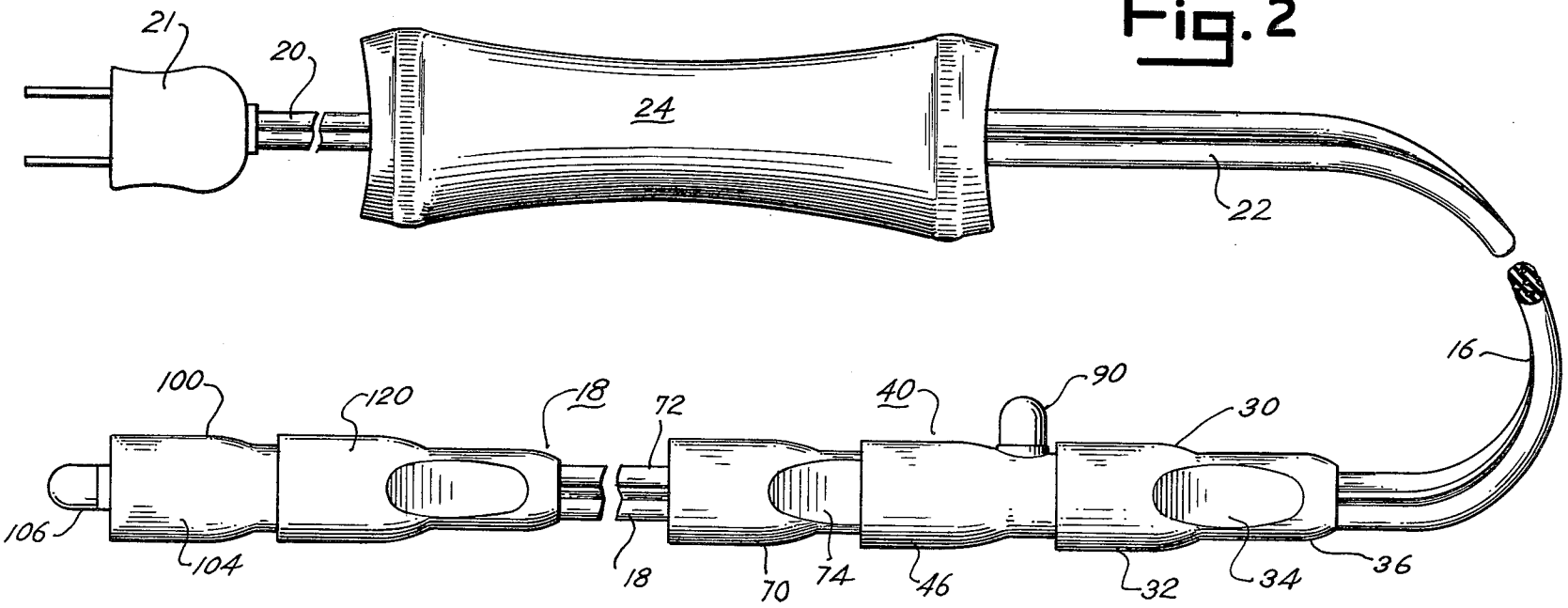
FIG. 2 is an enlarged elevational view of the modular heating cable as shown in FIG. 1.
Figure 3:
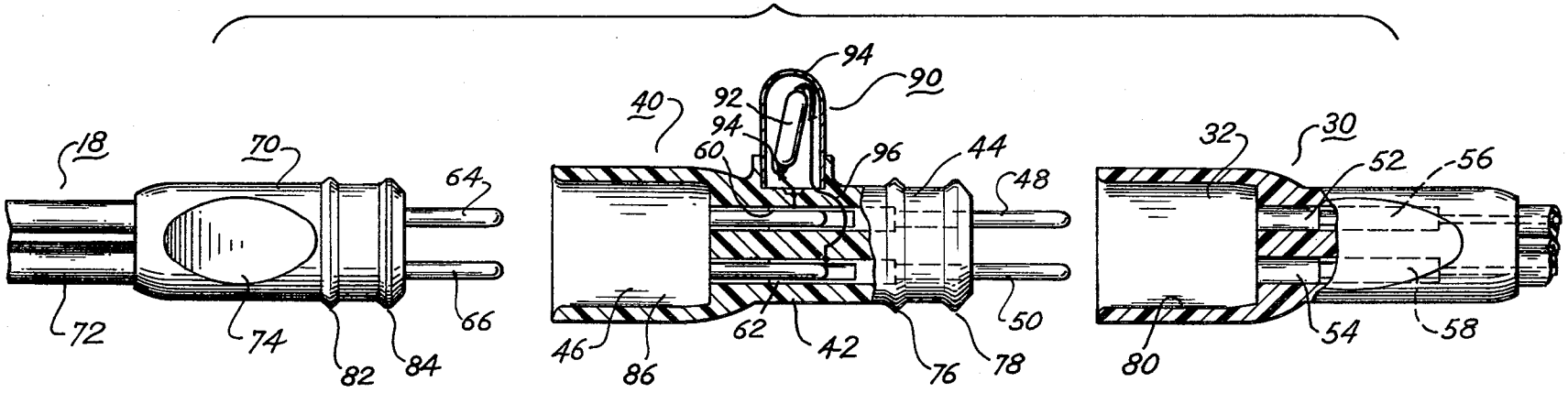
FIG. 3 is an exploded elevational and partial cross sectional view of the connectors and indicator device as shown in FIGS. 1 and 2.
Figure 4:
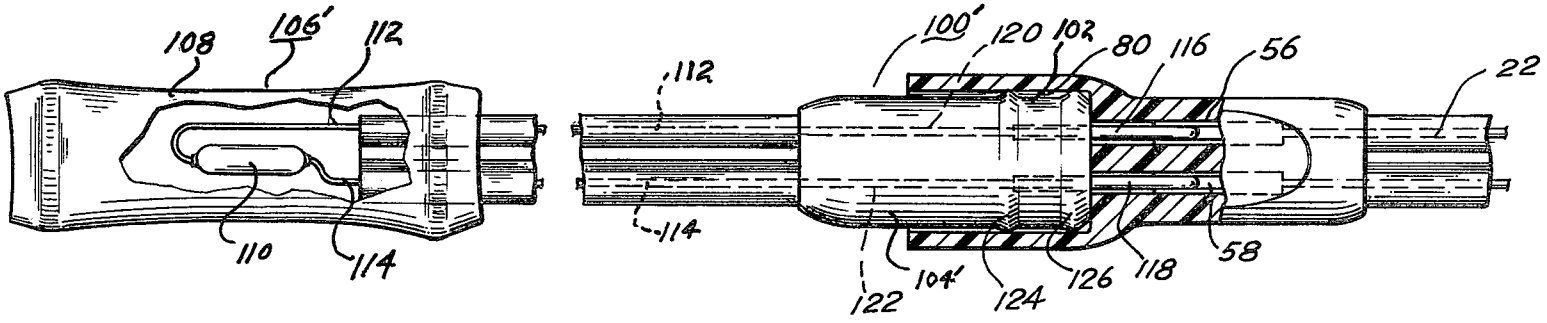
FIG. 4 is an enlarged elevational and partial cross sectional view of one connector and an indicator device mounted at the end of the assembly, as shown in FIGS. 1 and 2.

Since all modules 18 are identical in construction, with the exception of possible variations in length, the terminal 30 must have a closure to make the assembly fully water repellent. A modified form of the present invention satisfies this requirement and consists of indicator device 100 illustrated in FIG. 4, having a plug 102 and a body 104 with a light means 106 secured to the outer end thereof. The light means consists of a translucent plastic envelope or capsule 108 and a high resistance neon light 110 connected by leads 112 and 114 to terminals 56 and 58 by terminals 116 and 118 and lead wires 120 and 122 in body 104. FIGS. 2 and 4 illustrate two types of this modification, and since the two types are essentially the same, the same numerals with primes identify the same parts in FIG. 4. This latter type may also be used with a lead in place of capsule 94. The plug is provided with sealing rings 124 and 126 to seat on and form a water-tight seal with internal surface 80 of socket 32. Thus, it is seen that the indicator device 100 both performs the function of sealing the outer end of the last module and simultaneously provides an indicator for determining whether the cable assembly is operable. If an additional module is required, the indicator device 100 is removed, the module connected either directly to module 18 or to another indicator device 40, and plug 102 is seated in the socket of the final module.

In the operation and installation of the present modular heating cable and indicator assembly, a single module 16 can be used with indicator device 100, and additional modules 18 with indicator device 90, added thereto as required, in the manner illustrated in FIG. 1. The present invention as embodied in the two indicator devices 40 and 100 provides effective versatility to the cable assembly while simultaneously providing an effective means for determining whether the various modules are operable. As mentioned previously, while either or both indicator means 90 and 106 may be attached rigidly to the respective bodies 42 and 104, the lights may be enclosed in an envelope remote from the bodies and connected thereto by suitable leads, this latter arrangement permitting the indicator lights to be located at a position where they can be easily observed even though the cable assembly installation may be in a place somewhat difficult to reach or observe.

While only two embodiments of the present indicator device for modular heating cables have been described in detail herein, various changes and modifications may be made without departing from the scope of the invention.

I claim:

1. An indicator device for modular heating cables having male and female connectors for coupling two heating modules together, comprising a body with a plug having two terminals for connection with said female connector and forming a moisture proof connection with said female connector and a socket having two terminals for connection with said male connector and forming a moisture proof connection with said male connector, a pair of electrical conducting means connecting the terminals of said plug with the respective terminals of said socket, an indicator light means connected to said body in sealed relationship therewith and having a pair of leads, and means connecting said leads of said indicator light means to each of said electrical conducting means.

2. An indicator device for modular heating cables as defined in claim 1 in which said light means consists of a high resistance neon light.

3. An indicator device for modular heating cables as defined in claim 1 in which said light is enclosed in a translucent plastic envelope.

4. An indicator device for modular heating cables as defined in claim 2 in which said light is enclosed in a translucent plastic envelope.

5. An indicator device for modular heating cables as defined in claim 1 in which said plug fits snugly in the female connector to form a waterproof connection therewith.

6. An indicator device for modular heating cables as defined in claim 4 in which said plug fits snugly in the female connector to form a waterproof connection therewith.

7. An indicator device for modular heating cables having a male and a female connector for coupling two heating modules together, comprising a body with a plug having two terminals for connection with said female connector and forming a moisture proof connection with said female connector, an indicator light means connected to said body in sealing relationship therewith and having a pair of leads, and a pair of electrical conducting means connecting said light means to said terminals of said plug.

8. An indicator device for modular heating cables as defined in claim 7 in which said light means consists of a high resistance neon light.

9. An indicator device for modular heating cables as defined in claim 7 in which said light is enclosed in a translucent plastic envelope.

10. An indicator device for modular heating cables as defined in claim 8 in which said light is enclosed in a translucent plastic envelope.

11. An indicator device for modular heating cables as defined in claim 7 in which said plug fits snugly in the female connector to form a waterproof connection therewith.

12. An indicator device for modular heating cables as defined in claim 10 in which said plug fits snugly in the female connector to form a waterproof connection therewith.

* * * * *